US005334122A

United States Patent [19]

Cole et al.

[11] Patent Number: 5,334,122

[45] Date of Patent: * Aug. 2, 1994

[54] BIASING MEANS, COMPONENTS THEREFOR AND METHODS OF MAKING SAME

[75] Inventors: Richard W. Cole, Nixa; Clinton L. Bishop, Springfield, both of Mo.

[73] Assignee: Dayco Products, Inc., Dayton, Ohio

[ * ] Notice: The portion of the term of this patent subsequent to Sep. 7, 2010 has been disclaimed.

[21] Appl. No.: 71,123

[22] Filed: Jun. 2, 1993

Related U.S. Application Data

[62] Division of Ser. No. 792,513, Nov. 13, 1991, Pat. No. 5,242,353.

[51] Int. Cl.[5] ..... A63B 21/04

[52] U.S. Cl. ..... 482/130; 482/121; 482/123

[58] Field of Search ..... 482/121, 122, 126, 129, 482/123, 130, 124, 125

[56] References Cited

U.S. PATENT DOCUMENTS 3,529,820 9/1970 Templeton ..... 482/122
4,852,874 8/1989 Sceichter et al. ..... 482/126
5,135,216 8/1992 Bingham et al. ..... 482/130
5,242,353 9/1993 Cole et al. ..... 482/129

*Primary Examiner*—Richard J. Apley
*Assistant Examiner*—Lynne A. Reichard
*Attorney, Agent, or Firm*—Joseph V. Tassone; Richard L. Marsh

[57] ABSTRACT

A biasing means for an exercising machine is provided where one end of the biasing means is removably disposed on a lever arm of the exercising machine and the opposite end of the biasing means is disposed on a fixed support member of the exercising machine. The biasing means provides resistance to the movement of the lever arm in the plane of motion wherein the biasing means comprises at least one elastomeric band and a containing means to provide a bight on the ends of the biasing means for disposing on the respective portions of the machine. The biasing means may also have end members of support means placed within the bights. The biasing means, the containing means and the end members or support means may be initially separate and separable such that in the event of damage to any one of said means it may readily be replaced with another such elastomeric band means.

15 Claims, 6 Drawing Sheets

FIG.IC
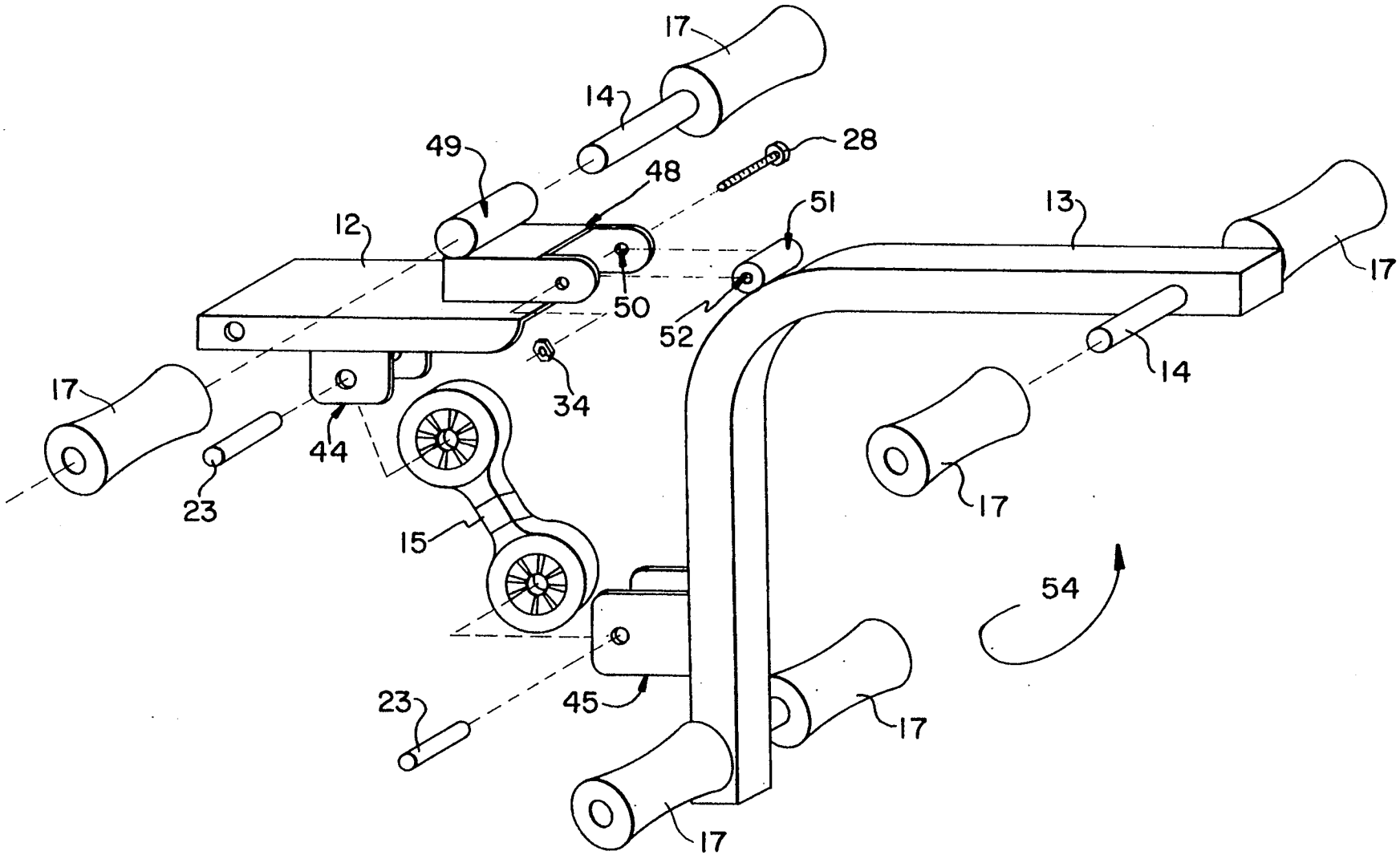

BIASING MEANS, COMPONENTS THEREFOR AND METHODS OF MAKING SAME

CROSS REFERENCE TO RELATED APPLICATIONS

This application is a divisional patent application of its co-pending parent patent application, Ser. No. 792,513 filed Nov. 13, 1991, now U.S. Pat. 5,242,353, issued Sep. 7, 1993.

BACKGROUND OF THE INVENTION

1. Field of the Invention

The present invention relates to physical exercise apparatus in general, to a biasing element for providing resistance to movement of the members of the physical exercise apparatus and to methods of making the biasing element.

2. Prior Art Statement

It is known to provide an exercising machine comprising a fixed support member and a movable lever arm pivotally disposed on the support member, a biasing means having a first end member attached to the support member and a second end member attached to the lever arm, wherein the biasing means such as a tension spring, selectively provides resistance to motion of the lever arm in the plane of motion, for instance, see U.S. Pat. No. 3,638,941 to Kulkens. It is also known to provide an exercising machine wherein the biasing means comprises elastic means such as aero shock cords, for instance, see the U.S. Pat. No. 4,072,309 to Wilson. It is also known to provide an exercising machine wherein the biasing means comprises elastic means such as weight straps, for instance, see the SOLOFLEX® brochure wherein said weight straps comprise elastomeric band means with end means molded thereon. It is also known to provide biasing means comprising elastic means similar to the weight straps as cited in the above brochure wherein the elastic means is a molded elastomeric slab with integrally molded ends as depicted in FIG. 7.

SUMMARY OF THE INVENTION

It is one feature of this invention to provide new elastic biasing means comprising at least one polymeric band means having end means within said polymeric band means.

It is another feature of this invention to provide new elastic biasing means wherein a polymeric band means is selected from elastomeric band means of differing tensile strength.

It is another feature of this invention to provide new elastic biasing means having containing means mounted on the elastomeric band approximately centrally located between the end means or separable end members disposed within said end means.

It is another feature of this invention to provide new elastic biasing means wherein said cross-sectional area of said polymeric band is in the shape of a regular polygon or the sector of a circle.

It is another feature of this invention to provide new elastic biasing means wherein the cross-sectional area of said polymeric band means is preselected from the modulus of the material selected.

It is another feature of this invention to provide new elastic biasing means wherein the end members are provided with flange means which is contiguous with at least one surface of said elastomeric band.

It is another feature of this invention to provide a novel method of assembling the biasing means of the instant invention wherein the end members are initially separate from the elastomeric band means and the containing means.

It is another feature of this invention to provide new elastic biasing means wherein the containing means comprises a tubular material selected from the group containing metals, thermoplastic, thermoset elastomers, woven or non-woven textiles.

It is another feature of this invention to provide new biasing means wherein said containing means is provided with reference characters indicating the relative strength, safety warnings, manufacturers identification or advertising markings.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1A:
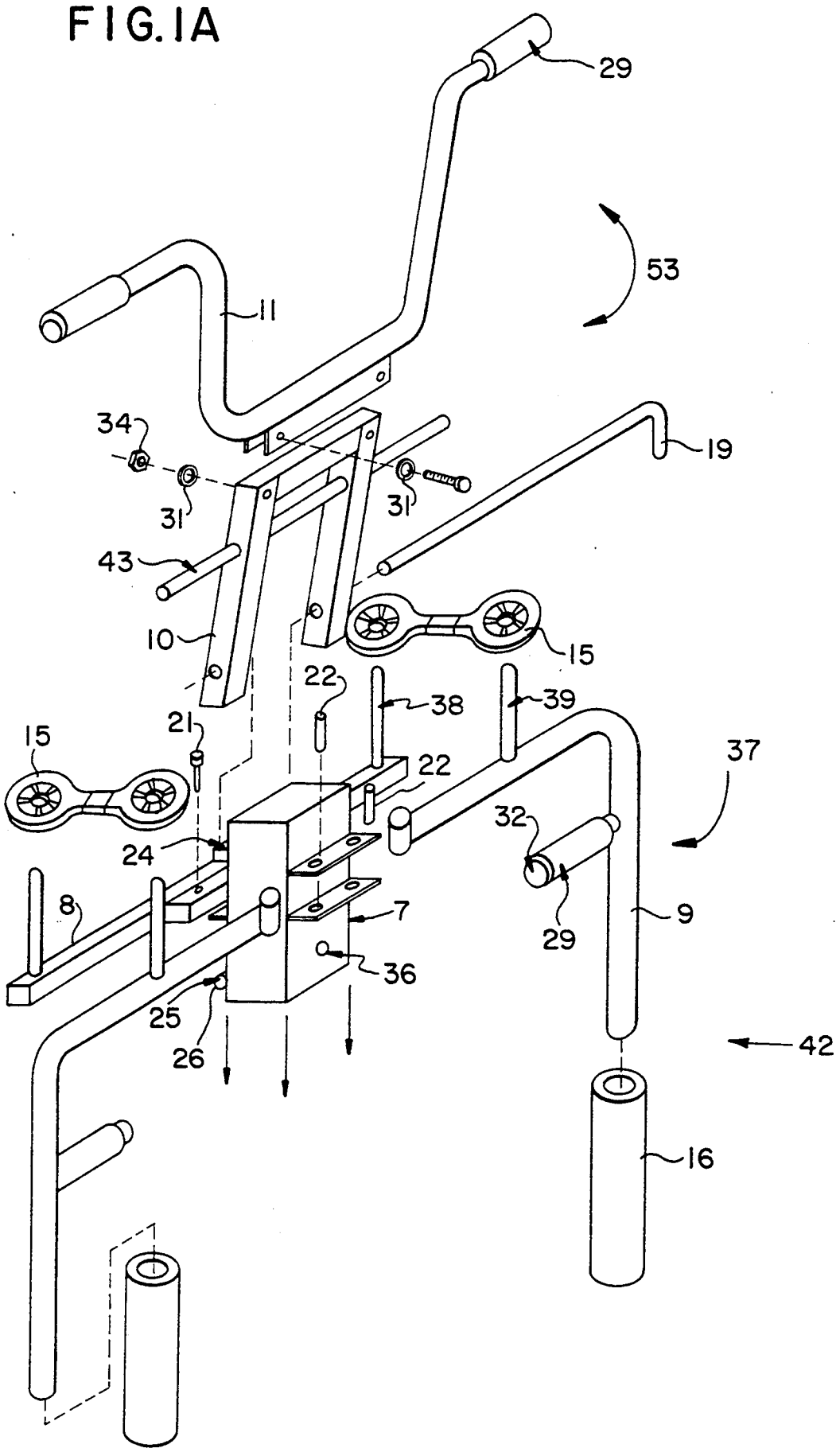
FIG. 1 is an exploded isometric view of an exercising machine showing the various parts thereof including the elastomeric band means of the instant invention; the machine being shown in three parts as FIGS. 1A, 1B, and 1C.
Figure 1B:
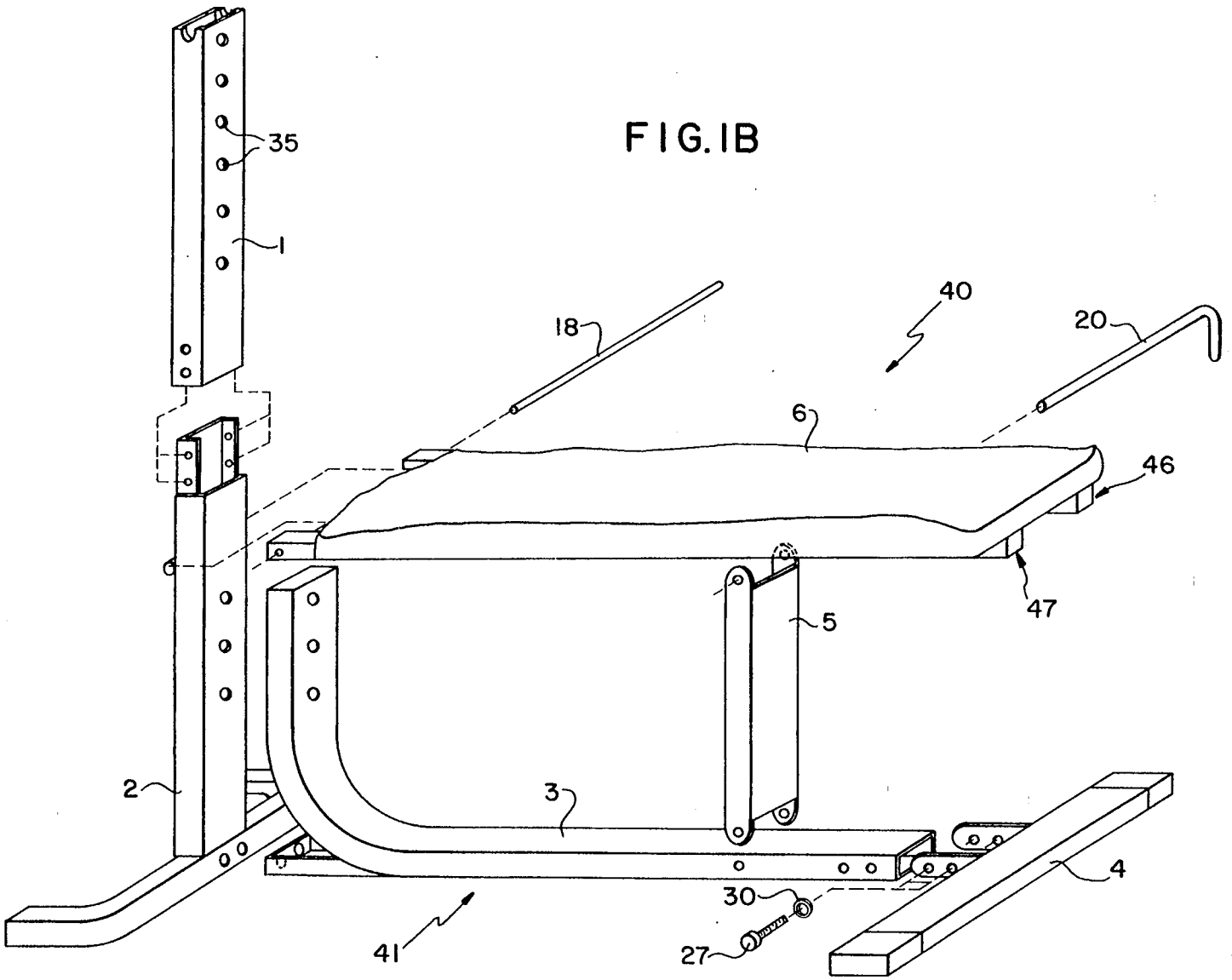
Figure 2:
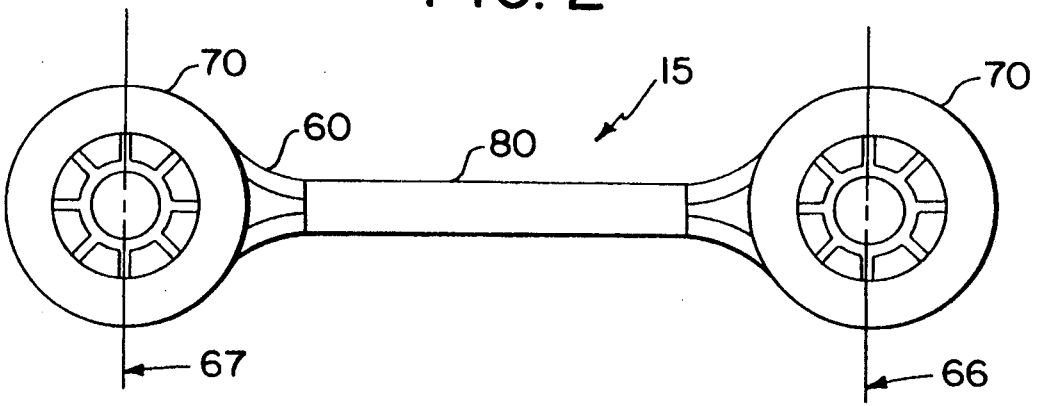
FIG. 2 is a plan view of the biasing means of the instant invention.

Referring now to FIG. 1, the exercising machine employing the biasing means of this invention is generally indicated by the reference numeral 40. A base portion generally indicated by reference numeral 41 comprising base means 3, lateral support means 4 and support foot means 2 is assembled using bolts 27, washers 30 and nuts 34. Upright support means 1 is similarly attached to support foot means 2 while bench means 6 is fitted to support foot means 2 and brace means 5 with removable pins means 18 and 20. An upper body exercise apparatus, generally indicated by reference numeral 42, comprises upper head means 7 with biasing support means 8 and arm lever means 9 mounted thereto with mounting pins 21 and 22 respectively and handlebar lever means 10 with handlebar means 11 attached thereto with bolts 27, washers 31 and nuts 33 fitted to upper head means 7 using handlebar lever pivot means 19 inserted through hole means 25 in pivot tube means 26 or opposite pivot tube means 24 welded to upper head means 7.

Upper body exercising apparatus 42 is slidably mounted upon upright support means 1 by inserting removable bolt means (not shown) through hole means 36 in upper head means 7 and through hole means 35 in upright support means 1. Handlebar grips 29 are fitted over the ends of handlebar means 11 and handles 32 on arm lever means 9. Foam grips 16 cover the ends of arm lever means 9 and foam pads 17 are fitted over fulcrum means 14 on leg lifting lever means 13 and lower head means 12.

Lower head means 12 is slidably disposed in slot means 46 between bench rails 47 and secured thereto with bench brace mounting pin 20 through holes (not shown) in bench rails 47 and hole means 55 in lower head means 12. Bracket means 44 is disposed on the under side of lower head means 12. Bracket means 48 including fulcrum mounting means 49 is disposed on the end of lower head means 12 opposite the end thereof which is slidably disposed within slot means 46. Leg lifting lever means 13 is rotatably mounted upon lower head means 12 with bolt 28 inserted through hole means 50 in bracket means 48 and hole means 52 in leg lifting frame pivot tube 51 and secured thereto with nut 34. Foam pads 17 are disposed on fulcrum means 14 inserted through fulcrum mounting means 49 and fulcrum means 14 on both ends of leg lifting lever means 13.

Biasing means 15 are mounted upon support pins 38 and lever pins 39 on either side of upper head means 7 wherein said biasing means 15 provide resistance to the movement of arm lever means 9 in a horizontal plane of motion indicated by reference arrow 37.

Biasing means 15 may alternately be fitted over handlebar lever means pins 43 and removable pin means 18 which has been inserted into pivot tube means 26 in upper head means 7 providing resistance to motion of handlebar lever means 10 in a vertical plane as indicated by the double ended reference arrow 53. Removable pin means 18 may also be placed in opposite pivot tube means 24 above handlebar lever pin means 43 with handlebar lever means 10 pivotably mounted in pivot tube 26 providing resistance to motion of handlebar lever means 10 in a downward vertical direction as well.

Similarly, biasing means 15 may alternately be placed within bracket means 44 on lower head means 12 and bracket means 45 on leg lifting lever means 13 securing same with biasing means mounting pins 23 providing resistance to motion of leg lifting lever in a vertical plane as indicated by reference arrow 54.

Figure 3:
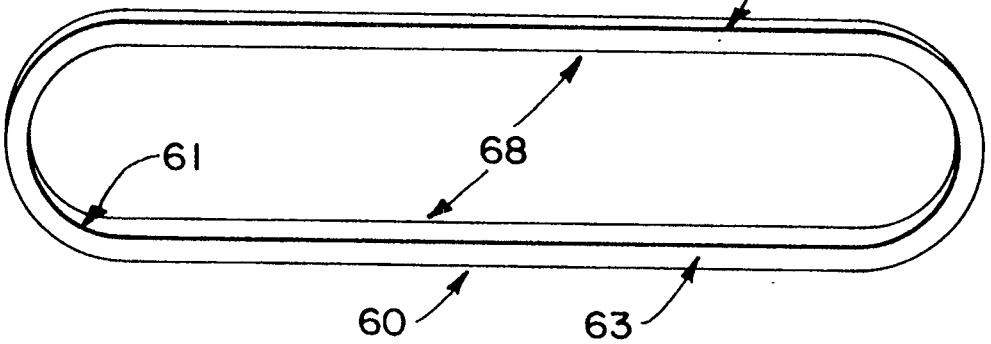
FIG. 3 is a isometric view of the elastomeric band means of the instant invention in an oval configuration prior to assembly.
Figure 4:
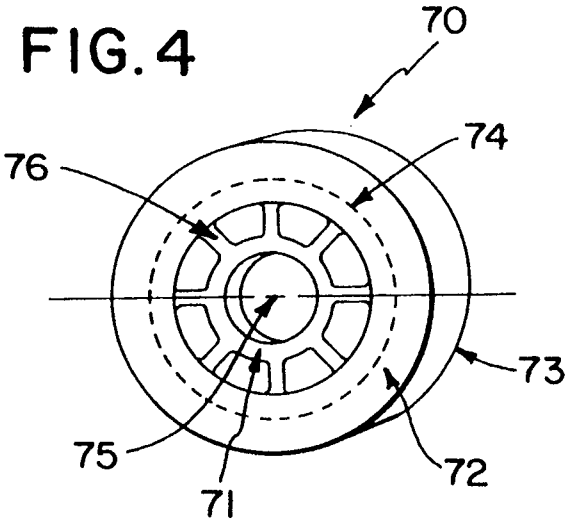
FIG. 4 is a isometric view of the end member of the instant invention.
Figure 5:
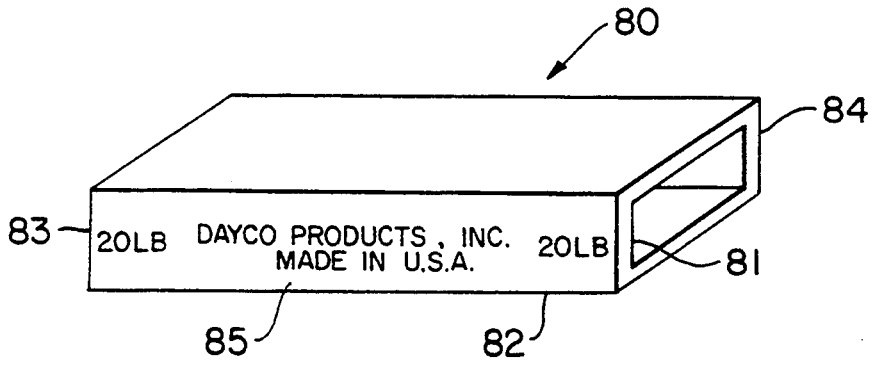
FIG. 5 is a plan view of the containing means of the instant invention showing customer's name located thereon.

Referring now to FIG. 2 through 5, biasing means 15 comprises elastomeric band means 60 of FIG. 3, end member 70 of FIG. 4 and containing means 80 of FIG. 5. Elastomeric band means 15 is taken transverse the longitudinal axis of each leg 68 and may be of any desired cross sectional configuration as shown in FIGS. 10–15, whereas in FIG. 3 inside surface 61 opposes outside surface 62 and first side edge 63 opposes second side edge (not shown), defining thereby a generally rectangular cross section elastomeric band means 60. End member 70 comprises hub means 71, an outer portion consisting of flange means 72 and 73, pulley surface 74, mounting hole means 75, and web means 76. Containing means 80 comprises a tube of elastomeric material with inside surface 81, outside surface 82, first end 83 and second end 84. Containing means 80 may also be provided with labeling means 85 disposed on outside surface 82 in any manner known in the art.

Figure 8:
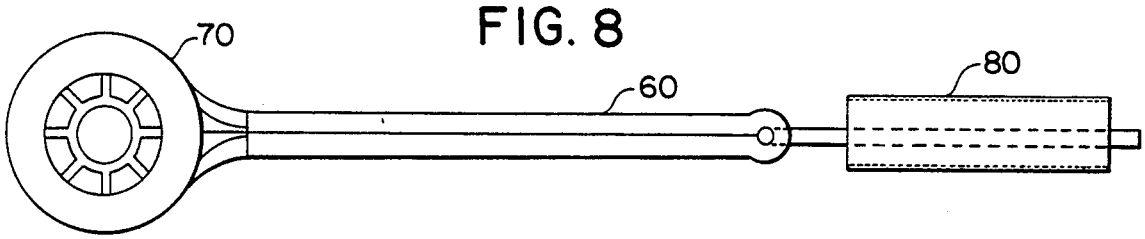
FIG. 8 is a plan view of the elastomeric band means of the instant invention disposed upon an assembly pin for assembly of the containment means.
Figure 9:
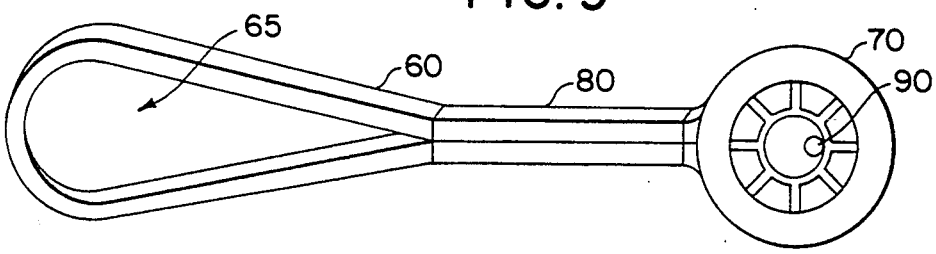
FIG. 9 is an isometric view of the biasing means of the instant invention showing one end member disposed on an assembly pin and a bight in the other end means of the elastomeric band means for insertion of another end member.
Figure 10:
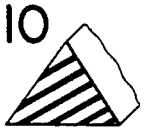
FIGS. 10–15 are views of various sections of the elastomeric band means which may be used for the instant invention.
Figure 11:
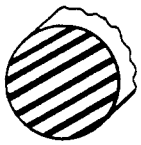
Figure 12:
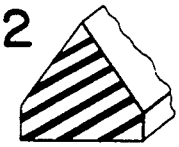
Figure 13:
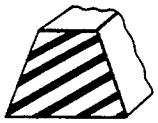
Figure 14:
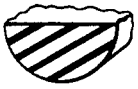
Figure 15:
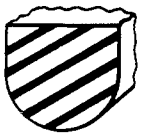

Referring now to FIG. 8 and FIG. 9, biasing means 15 is assembled by placing one end member 70 within bight 65 of elastomeric means 60 wherein the portion of inside surface 61 disposed within bight 65 of elastomeric band means 60 abuts a portion of pulley surface 74, and wherein first side edge 63 and second side edge (not shown) are contained between and contiguous with flange means 72 and 73 of end member 70. The opposite bight 65 is then placed over an assembly pin 90 which has containing means 80 placed thereon, elastomeric band means 60 is elongated by pulling upon end member 70 while containing means 80 is slidably moved from the position on assembly pin 90 toward end member 70 such that first end 83 of containing means 80 is adjacent end member 70. Inside surface 81 of containing means 80 is therefore contiguous with outside surfaces 62 and side edges 63 thereby containing elastomeric band means 60 in an oval configuration as shown in FIG. 10 when removed from assembly pin 90. Finally, a second end member 70 is placed within the open bight 65 of partially assembled biasing means 15 to produce the fully assembled biasing means 15 of FIG. 2. Assembly pin 90 may be utilized as shown in FIG. 10 to move containing means 80 toward the first end member 70 such that the second end member 70 may be more readily placed in bight 65 and to move containing means 80 to the final central position of biasing means 15.

Alternately, each bight 65 of elastomeric band means 60 may be placed upon mounting pins 90 and elongated to facilitate placement of containing means 80 in the central portion between bights 65 and then end member 70 may be separately placed within each bight 65 to provide the fully assembled biasing means 15.

Separate biasing means 15 of the instant invention may be constructed in a similar manner wherein the cross-sectional area of elastomeric band means 60 may be varied to provide a different amount of resistance to motion. For instance, the thickness of elastomeric band means 60 of FIG. 3 between outside surface 62 and inside surface 61 may be approximately 0.184 inch to provide a biasing means 15 which produces a resistance to movement of approximately 30 pounds when extended to 150% of the original distance from centerline 66 to centerline 67 which represents essentially the mid range of extension of any of the lever means of exercising means 40. Similarly, elastomeric band means 60 of FIG. 3 with a thickness between outside surface 62 and inside surface 61 of 0.368 inch will provide resistance of approximately 60 pounds when biasing means 15 is extended to 150% of the original distance between centerline 66 and 67. Therefore, biasing means 15 of FIG. 2 may be constructed of differing resisting strengths by changing the thickness of elastomeric band means 60 to provide a complete set of biasing means 15 for exercise apparatus 40 of FIG. 1.

Similarly, biasing means 15 of differing resisting strengths may be provided by altering the cross-sectional shape where said elastomeric band means 60 is other than rectangular in cross-section. For instance, see FIGS. 10–15 wherein various crossectional configurations of elastomeric band means 60 are shown. End member 70 may then also be altered to conform to the peripheral surface contour of elastomeric band means 60 such that elastomeric band means 60 is contained within first and second flange means 72 and 73 respectively while inside surface 61 of elastomeric band means 60 is supported by pulley surface 74 of end member 70.

The resisting strengths of the various elastomeric band means 60 of the instant invention are determined from the modulus of elasticity of the material selected. A modulus of elasticity curve of the material to be used for the elastomeric band means is determined by subjecting a tensile slab of the material to extension while measuring the force required to extend the material as is well known in the art. For instance, the force required to extend the material of elastomeric band means 60 to a length which is 33.3% greater than the original length was 1.089 pounds for a slab of material 0.250 inches wide by 0.040 inches thick. This yields a force per unit area of 108.9 pounds per square inch (psi). Therefore, in order to develop thirty pounds of force in biasing means 15 at an extension of 50% between the centerlines 66 and 67 which represents a 33.33 percent length extension of the entire length of elastomeric band means 60, the total crossectional area of each leg 68 would be 0.1377 square inches. Similarly, to develop ninety pounds of force in biasing means 15, the total cross-sectional area would be 0.413 square inches. Where elastomeric band means 60 is rectangular in cross-section and the width between flange means 72 and 73 of end member 70 is 0.750 inches, the thickness of elastomeric band means 60 would be the aforementioned 0.184 inches to develop thirty pounds whereas the thickness for elastomeric band means 60 would be 0.551 inches to develop ninety pounds.

Figure 6:
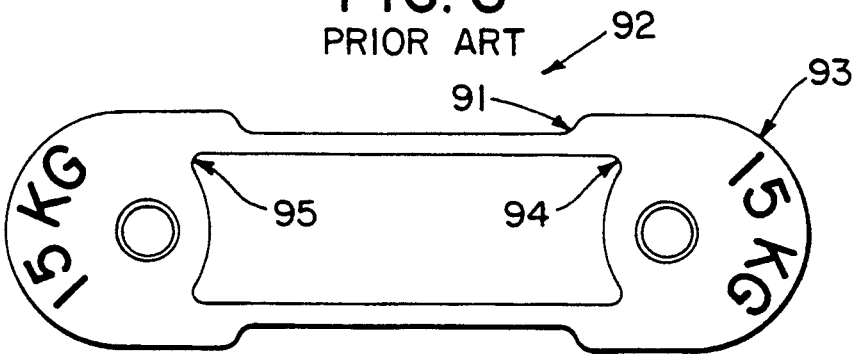
FIG. 6 PRIOR ART
FIG. 6 is a plan view of one of the biasing means of the prior art.

The biasing means 60 of the present invention overcomes the limitations of biasing means 92 of the prior art as shown in FIG. 6 which can readily rupture by a quickly propagating crack developing from any of the discontinuities present in the molding operation of the flat slab. For instance, the biasing means 92 of FIG. 6 is prone to such rupture at the recess shown by arrow 91 because the highest stress is concentrated at this location when the biasing means 92 of FIG. 6 is extended. This high stress is created because the end section 93 of biasing means 92 does not extend and hence all the elongation of biasing means 92 must take place between the points 94 and 95. In the instant invention, inside surface 61 of elastomeric band means 60 contained within the bights 65 of biasing means 15 contacts surface 74 of each end member 70 and therefore biasing means 15 is free to move thereon, hence the entire length of elastomeric band means 60 extends substantially equally since the cross-sectional area of each segment of elastomeric band means 60 is uniform throughout the entire length thereof. This unique combination of elastomeric band means 60, end member 70 and containment means 80 provide biasing means 15 free of stress concentrations present in the prior art biasing means.

The unique combination of elastomeric band means 60, end member 70 and containment means 80 further provide the user with an early warning of any impending failure as elastomeric band means 60 moves about end member 70 during each extension thereof. Since the cross-sectional area is constant throughout elastomeric band means 60, no undue stress concentrations are present but any small crack which may occur on the outer surface thereof, where the highest stress during extension occurs, due to age of the elastomeric means 60 will be visible upon simple inspection prior to use. The user can then replace biasing means 15 or the elastomeric band means 60 at a convenient time without fear of sudden rupture of biasing means 15 during exercise.

Figure 7:
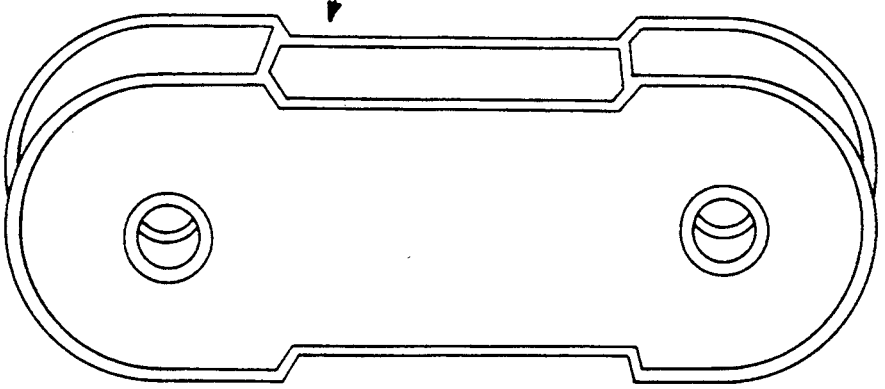
FIG. 7 PRIOR ART
FIG. 7 is a isometric view of another of the biasing means of the prior art.

The biasing means 15 of the present invention further provides a margin of safety to the user as the full resisting force of the biasing means is developed near the mid point of extension of the biasing means 15 rather than at the lesser extension of the prior art biasing means. For instance, the biasing means 15 with a thickness of 0.184 inch develops approximately 13.5 Kg at an extension of 150% of the original distance between centerlines 66 and 67 while biasing means 110 of FIG. 7 labeled 15 Kg develops approximately 63.5 kg at the same extension. At full extension of the lever means of machine 40, the biasing means of FIG. 7 develops approximately 100 Kg whereas the biasing means 15 develops only 30 Kg. Since the user will usually extend the biasing means to 80 to 100% of the full extension of the lever means, the biasing means of the prior art could cause over exertion and possible injury to the user. The biasing means 15 of the instant invention is therefore a much safer biasing means for the casual user of the machine 40.

The biasing means 15 of the instant invention may be provided with reference characters disposed upon the outside surface 82 of containing means 80 indicating the relative strength of the biasing means 15 without units of measurement thereon as in the prior art biasing means of FIG. 6. The reference characters may be numeric, alphabetic, symbolic or a combination thereof. The user of the exercising device 40 can then select biasing means 15 as desired for the exercise to be performed based upon previous experience eliminating the transfer of heavy weights from a weight rack.

The containing means 80 may be constructed of a material selected from the group comprising metals, thermoplastic or thermoset elastomers, woven or non-woven textile fabrics. The containing means 80 may be extruded, molded, woven, cast or formed by any means known in the art. The outer surface 82 of containing means 80 may be provided with labeling means 85 disposed thereon in a manner well known in the art. For instance, the containing means 80 of the instant invention has labeling means 85 disposed on the outer surface 82 by pad printing. The labeling means 85 comprises the company name, country of origin and an effort reference character of the biasing means 15. The labeling means 85 may further include safety information as desired by the customer or supplier or as required by Governmental agencies.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. A biasing means for use with an exercising machine having a fixed support member and a movable lever arm pivotally mounted on said support member, said biasing means comprising a first end means adapted to be detachably disposed on said lever arm and a second end means adapted to be detachably disposed on said support member for providing resistance to motion of said lever arm, at least one end member comprising outer supporting surfaces, said end member being placed within at least one of said end means, said end means being contiguous with only said outer supporting surfaces, said biasing means further having a central portion between said end means, and a longitudinal axis, and having a cross-sectional area measured transverse said longitudinal axis and having containing means disposed around said central portion of said biasing means.

2. The biasing means of claim 1 wherein the other of said end means has another of said end members placed therein.

3. The biasing means of claim 1 wherein said lever member and said support member have pins associated therewith said end members adapted to freely rotate upon said pins.

4. The biasing means of claim 3 wherein said end members rotate relative to said end means.

5. The biasing means of claim 3 wherein said end members rotate relative to said pins.

6. A biasing means for use with an exercising machine having a fixed support member and a movable lever arm pivotally mounted on said support member, said biasing means providing resistance to motion of said lever arm relative to said support member, said biasing means having a first end means adapted to be detachably disposed on said lever arm and a second end means adapted to be detachably disposed on said support member, said biasing means comprising a continuous polymeric band having a central portion between said end means, and a longitudinal axis, and having a cross-sectional area measured transverse said longitudinal axis, said band having a width and a thickness and having containing means disposed around said central portion of said band; said band having a tensile strength determined by varying its cross-sectional area, said cross-sectional area being in the shape of regular polygon; said cross-sectional area being rectangular; said cross-sectional area of said polymeric band is of constant width and varying thickness.

7. The biasing means of claim 6 further comprising one end member being placed within said end means, said end means being supported by said end member.

8. The biasing means of claim 7 wherein said end member comprises a hub portion and an outer portion wherein at least part of said outer portion is contiguous with at least one surface of said polymeric band.

9. The biasing means of claim 8 wherein said outer portion has a flange disposed thereon and wherein said flange is contiguous with at least one surface of said polymeric band.

10. The biasing means of claim 8 wherein said hub portion has mounting hole means disposed therein and wherein said mounting hole means is adapted to fit upon mounting pins of said lever arm, or said support member.

11. The biasing means of claim 10 wherein said mounting hole means is displaced from said outer portion by web means.

12. A biasing means for use with an exercising machine comprising a fixed support member and a movable lever arm pivotally mounted on said support member, said biasing means providing resistance to motion of said lever arm, said biasing means having a first end means detachably disposed on said lever arm and a second end means detachably disposed on said support member, said biasing means comprising a continuous polymeric band having a central portion between said end means, and a longitudinal axis, and having a cross-sectional area measured transverse said longitudinal axis, at least one end member comprising outer supporting surfaces, said end member being placed within at least one of said end means, said end means being contiguous with only said outer supporting surfaces, said biasing means having containing means disposed around said central portion of said band; wherein said containing means is disposed around said central portion approximately centrally between said end means.

13. The biasing means of claim 12 wherein said central portion of said continuous polymeric band has opposite sides with facing inner surfaces, said containing means contracting said opposite sides of said central portion toward each other to place at least a portion of each of said inner surfaces in intimate contact with each other.

14. The biasing means of claim 12 wherein said containing means comprises a tubular material selected from the group consisting of metals, thermoplastics, thermoset elastomers, and woven or non-woven textiles.

15. The biasing means of claim 14 wherein said containing means is a heat shrinkable material.

* * * * *